US006260942B1

(12) United States Patent
Ahne et al.

(10) Patent No.: US 6,260,942 B1
(45) Date of Patent: Jul. 17, 2001

(54) SENSOR AND METHOD FOR DETECTING PROTECTIVE TAPE ON A PRINTER CARTRIDGE

(75) Inventors: Adam Jude Ahne; Mark Joseph Edwards, both of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/425,632

(22) Filed: Oct. 22, 1999

(51) Int. Cl.[7] ..... B41J 2/175

(52) U.S. Cl. ..... 347/19; 347/86; 439/65; 439/67; 439/955

(58) Field of Search ..... 347/19, 86; 439/67, 439/65, 955

(56) References Cited

U.S. PATENT DOCUMENTS 6,161,915 * 12/2000 Bolash et al. ..... 347/19

* cited by examiner

*Primary Examiner*—Huan Tran
(74) *Attorney, Agent, or Firm*—Michael T. Sanderson

(57) ABSTRACT

A sensor and method for detecting the presence of a protective tape on a printer cartridge in contact with a printer cartridge interface, preferably a printer carrier cable, in a printer. The sensor includes at least a first contact and a second contact between the printer cartridge and printer carrier cable, and a protective tape on the printer cartridge. The protective tape bridges an electrical connection between the first contact and second contact when the printer cartridge is in contact with the printer carrier cable. The first and second contact are either both on the printer cartridge or on the printer cartridge interface, or one contact is one the printer cartridge while the other is on the printer cartridge interface. The protective tape is an electrically-conductive material, or alternately is non-conductive and can include either a metal strip or a conductive adhesive that bridges an electrical connection between the first contact and second contact. Also disclosed is a sensor circuit that includes a voltage source for applying a test potential between the first contact and the second contact with the protective tape on the printer cartridge bridging an electrical connection between the contacts when the printer cartridge is in contact with the printer cartridge interface, and a voltage sensor in the printer that is responsive to current between the first contact and second contact to thereby detect the presence of the protective tape. There is also shown a method of detecting the presence of a protective tape upon a printer cartridge installed into a printer cartridge interface of a printer including the steps of placing a protective tape on the printer cartridge, and then placing the printer cartridge with the protective tape in contact with the printer cartridge interface such that the protective tape contacts a first contact and a second contact to bridge an electrical connection. The method then includes the step of passing a current from the first contact to the second contact to thereby close a sensing circuit to generate a signal indicating the protective tape is present on the printer cartridge.

37 Claims, 7 Drawing Sheets

SENSOR AND METHOD FOR DETECTING PROTECTIVE TAPE ON A PRINTER CARTRIDGE

BACKGROUND OF THE INVENTION

1. Field of the Invention

The present invention generally relates to printers. More particularly, the present invention relates to a sensor in a printer for detecting the presence of a protective tape on a printer cartridge.

2. Description of the Related Art

New print heads and printer cartridges that include ink, such as ink jet printer cartridges, are usually supplied from the manufacturer with a piece of protective tape affixed thereto. In ink jet print heads and printer cartridges, the protective tape is typically applied over the nozzle plate to protect the nozzles from drying out and inadvertently leaking ink. The protective tape can also be used to protect the electrical contacts and terminals on the cartridge from damage. The protective tape must accordingly be removed from the printer cartridge prior to installation of the printer cartridge into the printer in order for the ink to flow for the printing function.

The installation instructions for the cartridges therefore direct the user to remove the protective tape prior to installation of the print head in the print head carrier, however, the printer users still often mistakenly install the printer cartridge onto the print head carrier with the protective tape still in place on the printer cartridge. The protective tape consequently prevents the printer from printing and users commonly believe that the printer is malfunctioning, instead of associating the problem with the unremoved protective tape. With the mistaken belief that the printer is malfunctioning, the printer users often contact the customer service center of the printer manufacturer and vendor to seek servicing of the printer. It can thus be seen that the simple failure to remove the protective tape generates unnecessary calls to the customer support centers of the manufacturer and vendor of the printer which adds cost to the printer assembly process and decreases the resources available for other significant customer service calls.

Thus, a method and apparatus that can detect the presence of the protective tape on a printer cartridge and notify the user of the printer of the presence of the protective tape would be advantageous. It is to the provision of such an improved method and apparatus that the present invention is primarily directed.

SUMMARY OF THE INVENTION

The present invention is sensor and method for detecting the presence of a protective tape on a print head or printer cartridge in contact with a printer cartridge interface, such as a printer carrier cable, in a printer. The sensor includes at least a first contact and a second contact between the printer cartridge and printer carrier cable, and a protective tape is on the printer cartridge for protection of the printer cartridge prior to installation into a printer. The protective tape bridges an electrical connection between the first contact and second contact, either directly or indirectly, when the printer cartridge is in contact with the printer carrier cable, or other printer cartridge interface.

The first contact and the second contact are preferably located on the printer cartridge interface, such as the printer carrier cable, or are located on the printer cartridge. Alternately, one of the first contact and the second contact is located on the printer cartridge interface, and the other of the first contact and second contact is located on the printer cartridge.

In one embodiment, the protective tape is non-conductive adhesive tape as is commonly used upon printer cartridges. The non-conductive protective tape then impedes a current from flowing between the contacts on the printer cartridge interface and printer cartridge. The non-conductive protective tape can impede a current between a first contact on the printer cartridge interface and a second contact on the printer cartridge, or can impede a current between two contacts for an existing function, such as temperature sensing of the printer cartridge.

The protective tape is, in another embodiment, an electrically-conductive material that conducts electricity throughout the tape. In a further embodiment, the protective tape has a non-conductive body and includes a metal strip that bridges an electrical connection between the first contact and second contact when the printer cartridge is placed in contact with the printer cartridge interface. Alternately, the protective tape can have a non-conductive body and with a conductive adhesive bonding the protective tape to the printer cartridge such that the conductive adhesive is between the protective tape and the first contact and second contact which are on the printer cartridge. Thus, the conductive adhesive on the protective tape bridges the electrical connection between the first contact and second contact, and the printer cartridge passes the voltage signal through the printer cartridge interface indicating that an electrical connection between the first contact and the second contact beneath the protective tape is bridged.

When the conductive protective tape includes a metal strip, the first contact and second contact are preferably raised contacts that touch the metal strip of the protective tape upon the print head printer cartridge being installed into the printer cartridge interface. Otherwise, the first contact and second contact are electrically conductive terminals as are known in the art.

The present invention accordingly provides a sensor circuit for detecting the presence of a protective tape on a printer cartridge for installation in a printer, the protective tape between the printer cartridge and printer cartridge interface in a printer. The circuit preferably includes a voltage source for applying a test potential between at least a first contact and a second contact between the printer cartridge and printer cartridge interface, and a protective tape on the printer cartridge. The protective tape bridges an electrical connection between the first contact and second contact when the printer cartridge is in contact with the printer cartridge interface, and the circuit further includes a voltage sensor in the printer that is responsive to current between the first contact and second contact to thereby detect the presence of the protective tape on the printer cartridge.

The inventive sensor circuit also alternately includes an indicator responsive to the voltage sensor where the indicator provides a signal to the user of the printer when the presence of the protective tape on the printer cartridge in installed position is detected. The indicator sends a signal to a display at the printer or to a host computer indicating that the protective tape is still on the printer cartridge.

In like manner to the sensor disclosed above, the first contact and the second contact are located on the printer cartridge interface, such as a printer carrier cable, or are alternately located on the printer cartridge or print head. However, in another embodiment, one of the first contact and the second contact is located on the printer carrier cable and the other of the first contact and second contact is located on the printer cartridge.

The protective tape is embodied in the sensor circuit as discussed above, and is in one embodiment made of a non-conductive material, or is alternately embodied as an electrically-conductive material. The protective tape alternately can be made of a non-conductive body and including a metal strip or having a conductive adhesive to bridge an electrical connection between the first contact and second contact. When the protective tape is embodied with the conductive adhesive, the printer cartridge passes the voltage signal through the printer cartridge interface to the voltage sensor in the printer indicating that an electrical connection between the first contact and the second contact is bridged.

The inventive sensor and sensor circuit thus provide a inventive method of detecting the presence of a conductive protective tape upon a printer cartridge installed into the printer cartridge interface of a printer. The method includes the steps of placing a protective tape on the printer cartridge to protect the printer cartridge until usage in the printer, and then placing the printer cartridge with the protective tape in contact with the printer cartridge interface of the printer such that the protective tape contacts at least a first contact and a second contact to bridge an electrical connection between the contacts. The method then includes the step of passing a current from the first contact to the second contact to thereby close a sensing circuit to generate a signal indicating the protective tape is present on the printer cartridge. The method alternately further includes the step of providing a signal to the user of the printer when the presence of the protective tape strip in the installed position is detected.

The step of placing the printer cartridge with the protective tape in contact with the printer cartridge interface of the printer is preferably placing the printer cartridge with the protective tape in contact with a printer carrier cable. The step of placing the printer cartridge with the protective tape in contact with the printer cartridge interface of the printer such that the protective tape contacts at least a first contact and a second contact to bridge an electrical connection between the contacts is alternately placing the printer cartridge with the protective tape in contact with the printer cartridge interface of the printer such that the protective tape contacts a first contact and second contact located on the printer cartridge interface. And the step of placing the printer cartridge with the protective tape in contact with the printer cartridge interface of the printer such that the protective tape contacts at least a first contact and a second contact to bridge and electrical connection between the contacts is alternately placing the protective tape on a first contact and a second contact on the printer cartridge to bridge an electrical connection between the first contact and second contact and then placing the printer cartridge in contact with the printer cartridge interface. Further, the step of placing the printer cartridge with the protective tape in contact with the printer cartridge interface of the printer such that the protective tape contacts at least a first contact and a second contact to bridge and electrical connection between the contacts is alternately placing the printer cartridge with the protective tape in contact with the printer cartridge interface of the printer such that the protective tape contacts one of the first contact and the second contact which is located on the printer carrier cable and the other of the first contact and second contact which is located on the printer cartridge to bridge an electrical connection between contacts.

The step of placing a protective tape on the printer cartridge to protect the printer cartridge until usage in the printer is placing a protective tape comprised of a non-electrically conductive material on the printer cartridge to protect the printer cartridge until usage in the printer. Alternately, the step of placing a protective tape on the printer cartridge to protect the printer cartridge until usage in the printer is preferably placing a protective tape comprised of an electrically-conductive material on the printer cartridge to protect the printer cartridge until usage in the printer. Alternately, the step of placing a protective tape on the printer cartridge to protect the printer cartridge until usage in the printer is placing a protective tape that has a non-conductive body and includes a metal strip that bridges an electrical connection between the first contact and second contact upon the printer cartridge to protect the printer cartridge until usage in the printer. And alternately, the step of placing a protective tape on the printer cartridge to protect the printer cartridge until usage in the printer is placing protective tape having a non-conductive body and including a conductive adhesive that bridges an electrical connection between the first contact and second contact upon the printer cartridge to protect the printer cartridge until usage in the printer.

The present invention thus provides a commercial advantage in that users of the printer can be made aware that the protective tape is still on the ink jet print head or printer cartridge, which would prevent unnecessary phone calls to the customer service center of a manufacturer. The savings of customer service resources that would otherwise be used for inquiring customers who left the protective tape on the printer cartridge results in improved customer service availability for more significant customer service calls.

Further, the present invention has industrial applicability in that the sensor can be integrated into printers for a minimal amount of cost, adding simple circuitry to the printer cartridge, print head and printer. The sensing of the protective tape can provide a simple signal to the printer user to remove the protective tape, which also minimizes the risk of any damage to the printer from operation without flowing ink.

Other objects, features, and advantage of the present invention will become apparent after review of the hereinafter set forth Brief Description of the Drawings, Detailed Description of the Invention, and Claims.

DETAILED DESCRIPTION OF THE INVENTION

Figure 1:
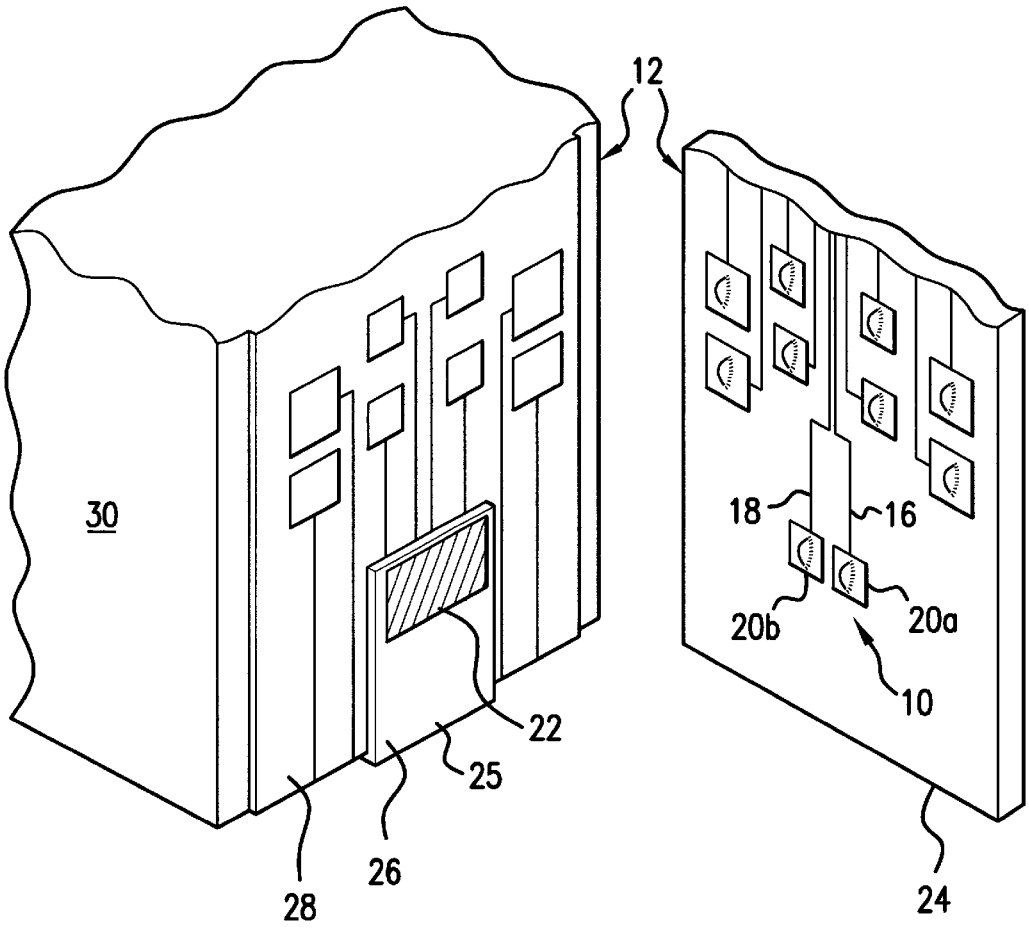
FIG. 1 is a perspective view of a printer cartridge and a printer carrier cable unconnected, with their respective electrical contacts displayed and the protective tape cover on the printer cartridge having a conductive metal strip.

Referring now to the drawings in which like numerals represent like components throughout the several views, FIG. 1 is a perspective view of a printer cartridge 30 and a printer cartridge interface, shown as printer carrier cable 24, which are unconnected, with the sensor 10 and the respective electrical contacts 12 displayed and the protective tape 26 on the printer cartridge 30. The protective tape 26 covers the one or more components of the connective face 28 of the printer cartridge 30, and has a conductive metal strip 22 that contacts the first contact 20*a* and second contact 20*b* on the printer carrier cable 24. The existing printer carrier cable 24 adds two additional bumped contacts 20*a* and 20*b* that are shorted through the metal strip 22 if the protective tape 26 is present when the printer cartridge 30 is loaded into the print head carrier (not shown). When the protective tape 26 is absent, first contact 20*a* and second contact 20*b* come to rest on an insulated area of the printer cartridge 30.

The term printer cartridge as used herein is intended to encompass any interchangeable cartridge for a printer that includes a print head, print head integrated circuit control chip and chip terminals, and ink. The printer cartridge can also include additional printer components and toner, or other components as known in the art of printer technology.

The sensor 10 includes at least a first contact 20*a* and a second contact 20*b* between the printer cartridge 30 and printer carrier cable 24, although more than two contacts are alternately used to comprise the sensor. The first contact 20*a* and second contact 20*b* are connected to the printer (not shown) at leads 16 and 18 respectively.

The protective tape 26 is on the printer cartridge 30 to prevent ink leakage from the printer cartridge 30, and can also provide protection of other electrical contacts 12 of the printer cartridge 30 prior to installation of the printer cartridge 30 into a printer. The protective tape 26, and in this embodiment the metal strip 22, bridges an electrical connection between the first contact 20*a* and second contact 20*b*, when the printer cartridge 30 is in contact with the printer carrier cable 24, or other printer cartridge interface of the printer.

Figure 3:
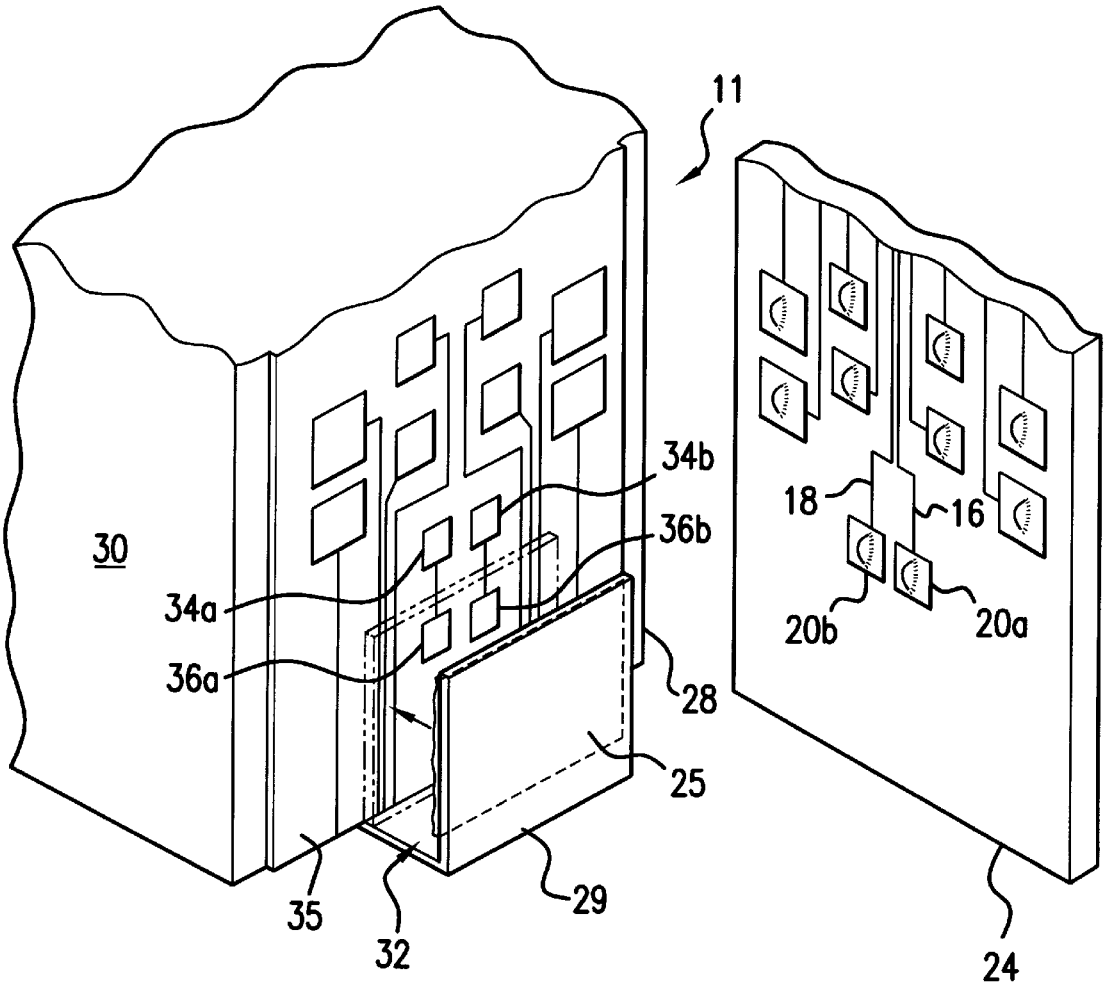
FIG. 3 is a respective view of a printer cartridge and a printer carrier cable unconnected, with their respective electrical contacts displayed and an alternate embodiment of the protective tape in a raised position with conductive adhesive partially over the electrical contacts of the printer cartridge.

The first contact 20*a* and the second contact 20*b* are preferably located on the printer cartridge interface 24, such as the printer carrier cable 24, but can be located on the printer cartridge 30 as shown in FIG. 3, in the embodiment of FIG. 1, the protective tape 26 has a non-conductive body 25 and includes a metal strip 22 that bridges an electrical connection between the first contact 20*a* and second contact 20*b* when the printer cartridge 30 is placed in contact with the printer cartridge interface, or printer carrier cable 24. When the protective tape 26 includes a metal strip 22, the first contact 20*a* and second contact 20*b* are preferably raised contacts that first touch the metal strip 22 of the protective tape 26 upon the printer cartridge 30 being installed into the printer cartridge interface. Otherwise, the first contact 20*a* and second contact 20*b* are alternately electrically conductive terminals as are known in the art.

Figure 2:
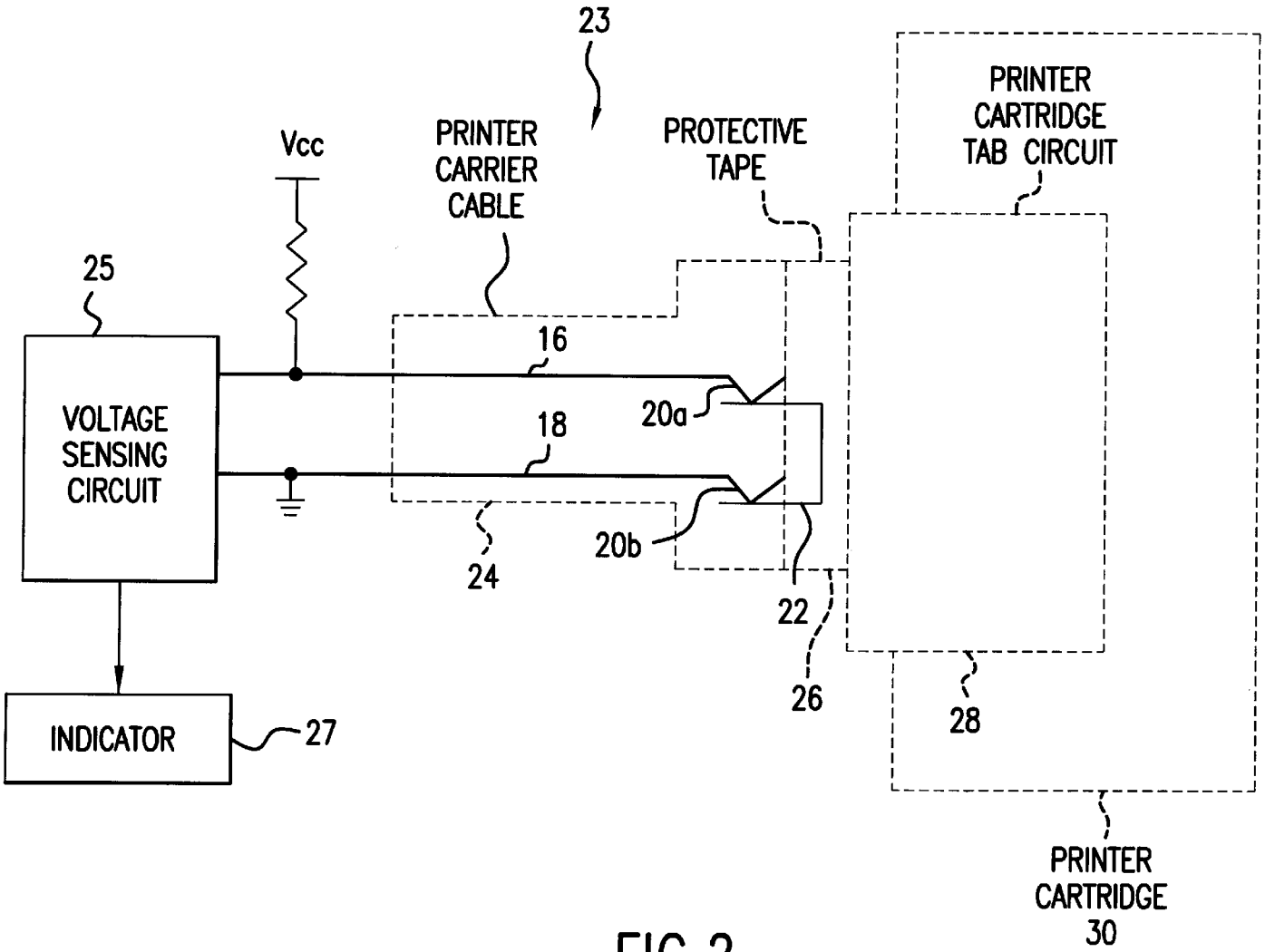
FIG. 2 is a block diagram of the sensor circuit of FIG. 1, specifically the printer carrier cable and the printer cartridge tab circuit with the sensor circuit closed due to the presence of the protective tape.

FIG. 2 illustrates a sensor circuit 23 for detecting the presence of a protective tape 26 on a printer cartridge 30 installed into a printer. The presence of a voltage on wire 16 when the circuit 23 is open is shown as Vcc. The voltage on wire 16 becomes ground when the circuit is closed between the first contact 20*a* and the second contact 20*b* through the presence of the metal strip 22 on the protective tape 26. Vcc and ground are discriminated through an appropriate voltage sensing circuit 25, such as a comparator, and a signal is provided to the indicator 27 which then generates an error message back to the user. Indicator 27 is alternately the printer controller for the printer and can cease operation of the printer when the protective tape 26 is present.

The circuit 23 preferably includes a voltage source from the printer, here provided from voltage sensing circuit 25, where the voltage source applies a test potential between the first contact 20*a* and the second contact 20*b* with the metal strip 22 of the protective tape 26 closing the circuit between the contacts 20*a* and 20*b*. The voltage sensing circuit 25 is preferably within the printer and is solely responsive to current between the first contact 20*a* and second contact 20*b* occurring from the closed circuit created by the presence of the metal strip 22 of protective tape 26 to thereby detect the presence of the protective tape 26 on the printer cartridge 30.

The sensor circuit 23 preferably includes indicator 27 responsive to the voltage sensing circuit 25 where the indicator 27 provides a signal to the user of the printer through whatever printer display or controls are present. Such signal can be a visual signal as in a LCD display on the front of the printer, or can be an audible signal or any other printer signal as known in the art.

With reference to FIG. 3, there is shown a perspective view of an alternate embodiment of the sensor 11 for the printer cartridge 30 and a printer carrier cable 24, shown here as unconnected. The protective tape 29 is embodied with a non-permanent conductive adhesive 32 to adhere to the connective face 28 of the printer cartridge 30. Additional contacts 36*a* and 36*b* are provided on a print head TAB circuit 35 on the connective face 28, and additional contacts 36*a* and 36*b* are covered by protective tape 29 and will be covered by the conductive adhesive 32. Further, additional contacts 34*a* and 34*b* are in connection with contacts 36*a* and 36*b*, and are on TAB circuit 35 above the protective tape 29 in a position to bridge an electrical connection with first contact 20*a* and second contact 20*b* on the printer carrier cable 24.

Thus, while the protective tape 29 is in place, a low impedance exists between contacts 36*a* and 36*b*, and consequently between contact pairs 34*a* and 34*b* and 20*a* and 20*b* respectively. Once the protective tape 29 is removed, a high impedance will exist between the respective pairs of contacts.

Thus, the conductive adhesive 32 on the protective tape 29 bridges the electrical connection between the contact 36*a* and 36*b* which then ultimately creates a closed circuit between first contact 20*a* and second contact 20*b*. In this embodiment, the closing of the sensing circuit occurs on the printer cartridge 30 and the voltage signal passes through the printer cartridge interface, or printer carrier cable 24, indicating that an electrical connection between contact 36*a* and contact 36*b* beneath the protective tape is bridged.

Figure 4:
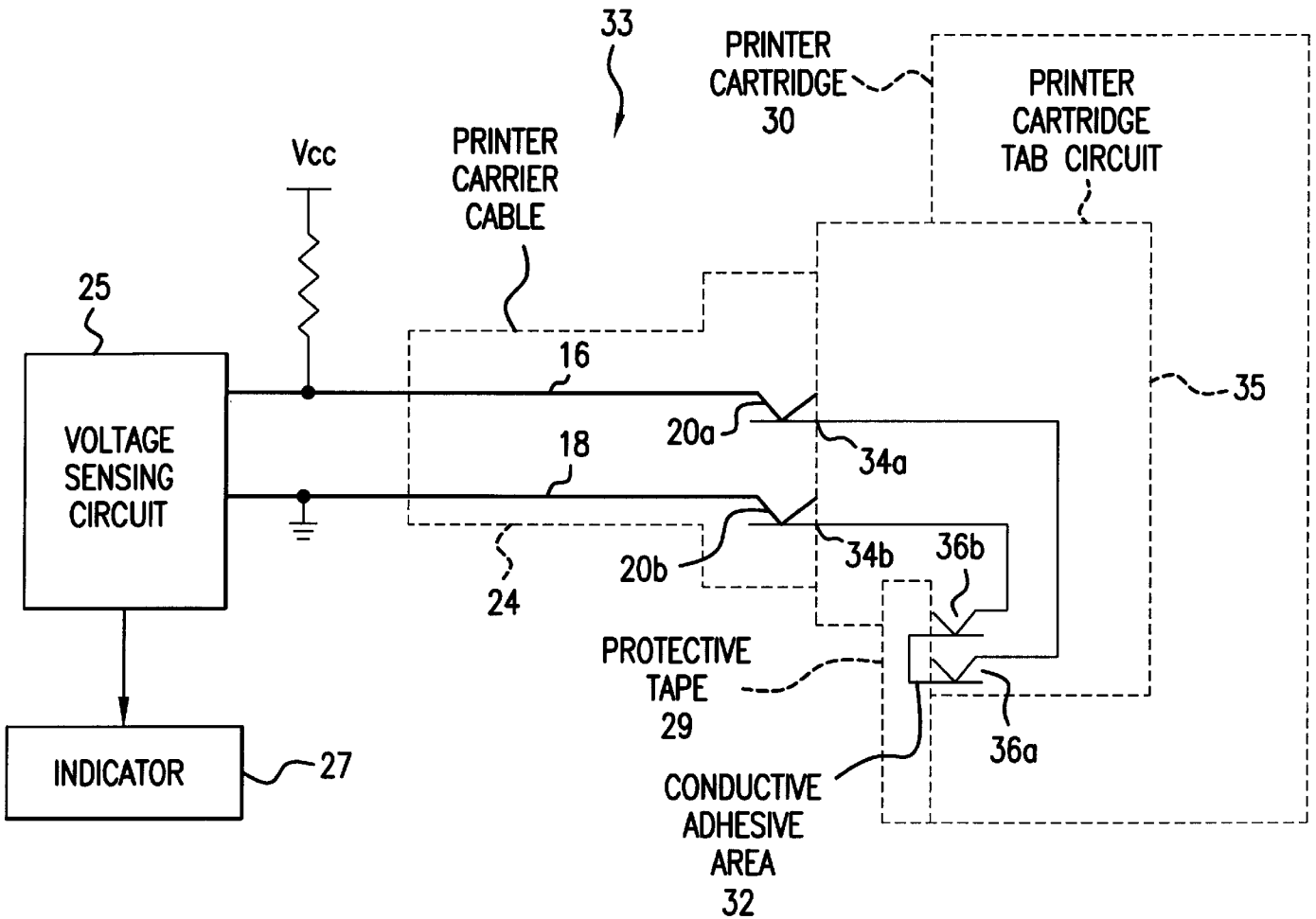
FIG. 4 is a block diagram of the sensor circuit of FIG. 3, specifically the printer carrier cable and the printer cartridge tab circuit with the sensor circuit closed due to the presence of the protective tape.

The sensing circuit 33 for the sensor 11 of FIG. 3 is shown in the block diagram of FIG. 4. Here, the voltage on wire 16 when the circuit is open is Vcc and the voltage on wire 16 is near ground when the circuit 33 is closed. The protective tape 29 closes the circuit 33 by bridging an electrical connection between contacts 36*a* and 36*b*, which respectively passes a current through contacts 34*a* and 34*b* and then first contact 20*a* and second contact 20*b* respectively. Therefore, the actual closure of the circuit 33 to signal the presence of the protective tape 29 occurs on the printer cartridge 30 and not at the printer cartridge interface, or printer carrier cable 24.

Figure 5:
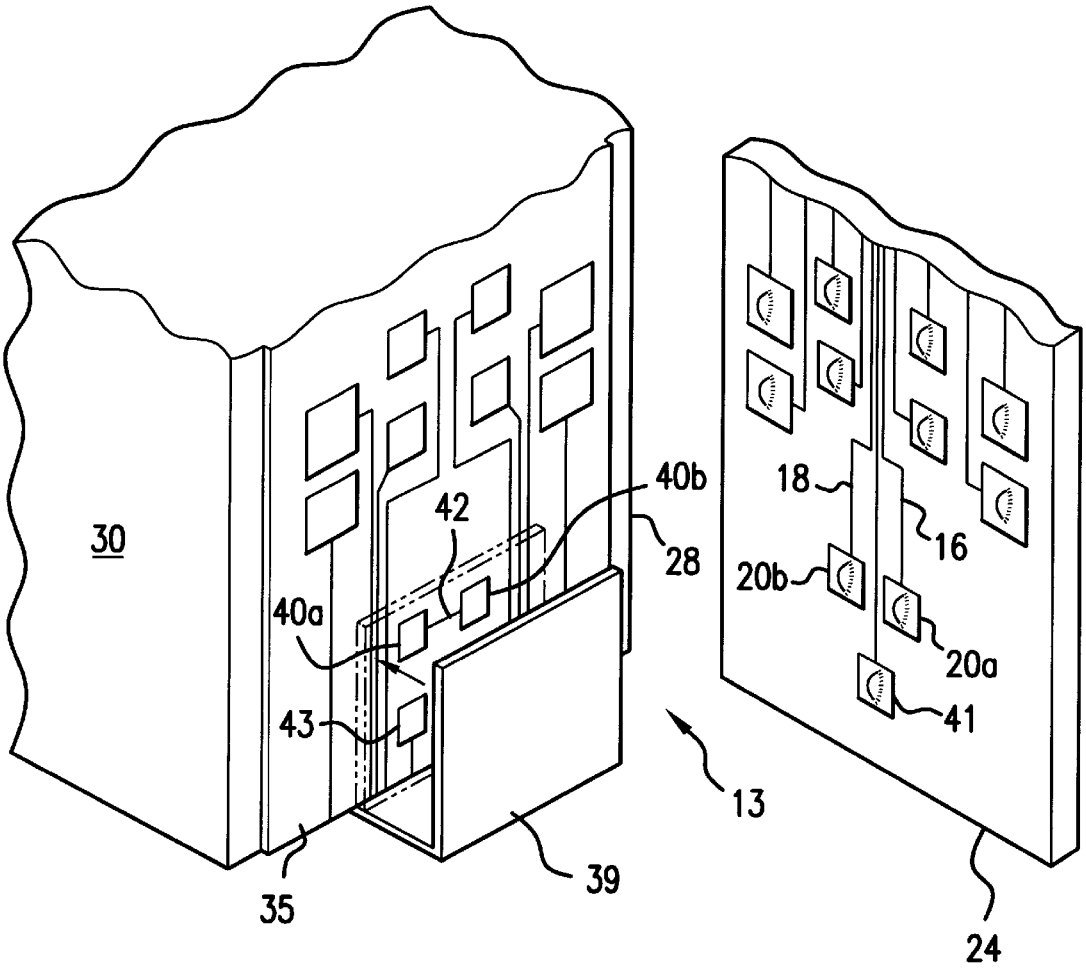
FIG. 5 is a perspective view of a printer cartridge and a printer carrier cable unconnected, with an alternate embodiment of the contacts on the printer cartridge and the protective tape of the printer cartridge displayed in a raised position.

With reference to FIG. 5, there is shown a perspective view of a printer cartridge 30 and a printer carrier cable 24 unconnected, with an alternate embodiment of the sensor 13 using a closed circuit to indicate that the protective tape 39 is not present. This embodiment of the sensor 13 provides two additional contacts for first contact 20*a* and second contact 20*b* on the printer carrier cable 24, the additional third contact 40*a* and fourth contact 40*b* are electrically connected at connection 42 on the print head TAB circuit 35 on the connective face 28 of the printer cartridge 30. With the protective tape 39 in place, the sensing circuit is open between the two cable contacts 20*a* and 20*b* indicating that the protective tape 39 is present. And with the protective tape 39 removed, first contact 20*a* connects to third contact 40*a* and second contact 20*b* is connected to fourth contact 40*b*, and due to connection 42, the sensing circuit is closed and the voltage present indicates that the protective tape 39 is not present.

The non-conductive protective tape 39 is embodied as a non-conductive material that prevents an electrical connection being bridged between first contact 20*a*, second contact 20*b*, third contact 40*a*, and fourth contact 40*b*. Thus, this embodiment of the invention is preferred as it typically does not require modification of the protective tape 39 for the printer cartridge 30, and only requires the inclusion of at least one contact, instead of the disclosed contacts 40*a* and 40*b*, on the printer cartridge 30 where the one contact bridges an electrical connection between the first contact 20*a* and second contact 20*b* when the printer cartridge 30 is installed into the printer cartridge interface 24 without the protective tape 39 present.

In such embodiment, the non-conductive tape 39 can also be used to block an existing connection between the printer cartridge 30 and printer cartridge interface. As an example, temperature sensor contact 41 on the printer carrier cable 24 and reciprocal contact 43 on the printer cartridge 30 are impeded from electrically connecting when the protective tape 39 is placed on the printer cartridge 30 over contact 43. Thus, when the printer cartridge 30 is installed into the printer cartridge interface, the temperature sensor 41 cannot receive electrical signals from the printer cartridge 30, and the sensing circuit can determine that the protective tape 39 is still upon the installed printer cartridge 30 from the failure of the temperature sensor. Other functions of the electrical connection between the printer cartridge 30 and printer cartridge interface can likewise be affected by a non-conductive protect tape being applied to impede the contacts such that the presence of the protective tape can be determined by the specific affecting of the function.

Figure 6:
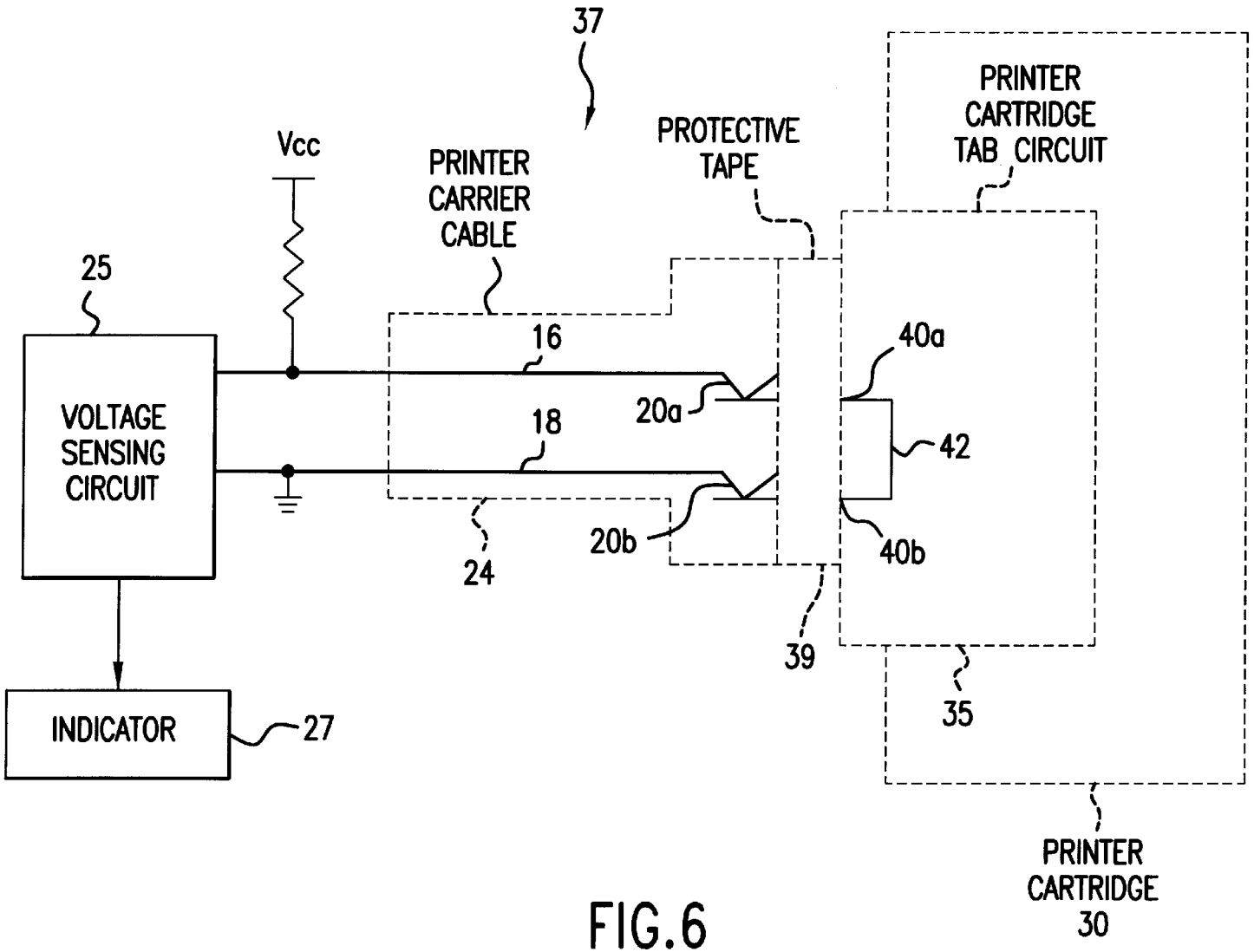
FIG. 6 is a block diagram of the sensor circuit of FIG. 5, specifically illustrating the printer carrier cable and the printer cartridge tab circuit with the sensor circuit closed due to the presence of the protective tape.

The sensing circuit 37 of sensor 13 is shown in FIG. 6. Here, the voltage on wire 16 when the circuit is open is Vcc and the voltage on wire 16 is near ground when circuit 37 closed. The protective tape 39 opens the circuit 37 by blocking an electrical connection between first contact 20*a*, second contact 20*b*, and third contact 40*a* and fourth contact 40*b*. When the printer cartridge 30 is installed with the protective tape 39 absent, an electrical connection is then bridged between first contact 20*a*, second contact 20*b*, and third contact 40*a* and fourth contact 40*b* respectively. Therefore, the actual closure of the circuit 37 to signal the absence of the protective tape 39 occurs on the printer cartridge 30 and not at the printer cartridge interface, or printer carrier cable 24.

Figure 7:
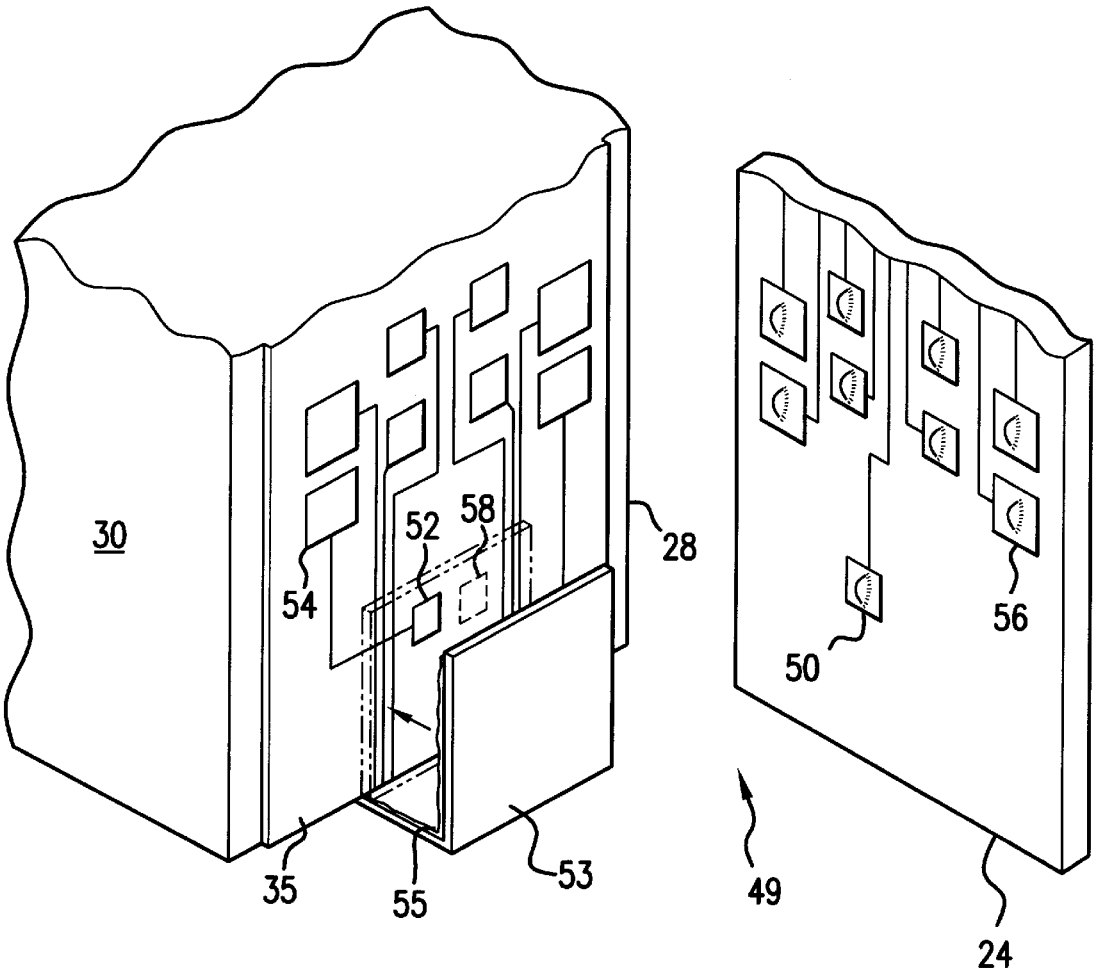
FIG. 7 is a perspective view of a printer cartridge and a printer carrier cable unconnected, with their respective electrical contacts displayed and an alternate embodiment of a protective tape having an electrically-conductive body raised over a second contact on the printer cartridge.

With reference to FIG. 7, there is shown a perspective view of a further embodiment of the sensor 49 printer cartridge 30 and a printer carrier cable 24 unconnected, with the first contact 50 on the printer carrier cable 24 and the second contact 52 on the printer cartridge 30. The protective tape 53 has an electrically-conductive body and conductive adhesive 55 and closes a circuit between the first contact 50 and second contact 52 through bridging an electrical connection therebetween. Second contact 52 is electrically connected to another contact 54 on the print head TAB circuit 35 on the connective face 28 of the printer cartridge 30. Contact 54 connects with a mirroring contact 56 on the printer carrier cable 24 to provide a circuit with current flowing from first contact 50 through protective tape 53 to second contact 52, and then to contacts 54 and 56, and thus to a sensing circuit in the printer.

The protective tape 53 is embodied as an electrically-conductive material that conducts electricity throughout the tape. This allows a staggered relation between the first contact 50 on the printer cartridge interface, and the second contact 52 located on the printer cartridge 30 which is covered by the protective tape 53. In like manner to the sensing circuits of FIGS. 2 and 4, this embodiment of the sensor 49, a closed circuit, or a ground voltage indicates the presence of the protective tape 53 on the printer cartridge. When the protective tape 53 is removed, the first contact 50 impacts a non-conductive area, shown as area 58, on the connective face 28 of the printer cartridge 30, and no current passes between the first contact 50 and the second contact 52.

As shown in FIGS. 1 and 2, the inventive sensor and sensor circuit thus provide an inventive method of detecting the presence of a protective tape 25 upon a printer cartridge 30 installed into the printer cartridge interface of a printer. The method includes the steps of placing a protective tape 26 on the printer cartridge 30 to protect the printer cartridge 30 until usage in the printer, and then placing the printer cartridge 30 with the protective tape 26 in contact with the printer cartridge interface, shown here as printer carrier cable 24, of the printer such that the metal strip 22 of protective tape 26 contacts at least a first contact 20*a* and a second contact 20*b* to bridge and electrical connection between the contacts. The method then includes the step of passing a current from the first contact 20*a* to the second contact 20*b* to thereby close a sensing circuit 23 (FIG. 2) to generate a signal indicating the protective tape 26 is present on the printer cartridge 30. The method alternately further includes the step of providing a signal to the user of the printer, preferably from indicator 27, when the presence of the protective tape 26 in the installed position is detected.

The step of placing the printer cartridge 30 with the protective tape 26 in contact with the printer cartridge interface of the printer is preferably placing the printer cartridge 30 with the protective tape 26 in contact with a printer carrier cable 24. The step of placing the printer cartridge 30 with the protective tape 26 in contact with the printer cartridge interface of the printer such that the protective tape 26 contacts at least a first contact 20*a* and a second contact 20*b* to bridge an electrical connection between the contacts is alternately placing the printer cartridge 30 with the protective tape 26 in contact with the printer cartridge interface of the printer such that the protective tape 26 contacts a first contact 20*a* and second contact 20*b* located on the printer cartridge interface. And the step of placing the printer cartridge 30 with the protective tape 26 in contact with the printer cartridge interface of the printer such that the protective tape 26 contacts at least a first contact 20*a* and a second contact 20*b* to bridge or break an electrical connection between the contacts is alternately placing the protective tape 26 on a first contact 36*a* or 40*a* and a second contact 36*b* or 40*b* on the printer cartridge 30 (as shown in FIGS. 3 and 5) to bridge or break an electrical connection between the first contact 20*a* and second contact 20*b* when placing the printer cartridge 30 in contact with the printer cartridge interface. Further, the step of placing the printer cartridge 30 with the protective tape 26 in contact with the printer cartridge interface of the printer such that the protective tape 26 contacts at least a first contact 20*a* and a second contact 20*b* to bridge an electrical connection between the contacts is alternately, as shown in FIG. 7, placing the printer cartridge 30 with the protective tape 53 in contact with the printer cartridge interface of the printer such that the protective tape 53 contacts one of the first contact 50 which is located on the printer carrier cable and the second contact 52 which is located on the printer cartridge 30 to bridge an electrical connection between the contacts.

The step of placing a protective tape 53 on the printer cartridge 30 to protect the printer cartridge 30 until usage in the printer is preferably placing a protective tape 53 comprised of an electrically-conductive material and conductive adhesive on the printer cartridge 30 to protect the printer cartridge 30 until usage in the printer, as shown in FIG. 7. Alternately, the step of placing a protective tape 26 on the printer cartridge 30 to protect the printer cartridge until usage in the printer is, as shown in FIG. 1, placing a protective tape 26 that has a non-conductive body 25 and includes a metal strip 22 that bridges an electrical connection between the first contact 20*a* and second contact 20*b* upon the printer cartridge 30 to protect the printer cartridge 30 until usage in the printer. Yet alternately, the step of placing a protective tape 29 on the printer cartridge 30 to protect the printer cartridge 30 until usage in the printer is, as shown in FIG. 3, placing protective tape 29 having a non-conductive body 25 and including a conductive adhesive 32 that bridges an electrical connection between the first contact 20*a* and second contact 20*b* upon the printer cartridge to protect the printer cartridge 30 until usage in the printer. And alternately, the step of placing a protective tape 39 on the printer cartridge 30 to protect the printer cartridge until usage in the printer is, as shown in FIG. 5, placing a non-conductive protective tape 39 upon the printer cartridge 30 to protect the printer cartridge 30 until usage in the printer where the non-conductive tape 39 blocks a current from flowing between first contact 20*a* and second contact 20*b*.

While there has been shown a preferred and alternate embodiments of the present invention, it is to be understood that certain changes may be made in the forms and arrangements of the components and steps of the inventive method without departing from the spirit and scope of the invention as set forth in the claims appended herewith

What is claimed is:

1. A sensor for detecting the presence of a protective tape strip on a printer cartridge in contact with a printer cartridge interface in a printer, comprising: a first contact and a second contact between the printer cartridge and printer cartridge interface; and a protective tape on the printer cartridge, wherein the protective tape bridges an electrical connection between the first contact and second contact when the printer cartridge is in contact with the printer cartridge interface.

2. The sensor of claim 1, wherein the printer cartridge interface is a printer carrier cable.

3. The sensor of claim 2, wherein the first contact and the second contact are located on the printer carrier cable.

4. The sensor of claim 1, wherein the first contact and the second contact are located on the printer cartridge.

5. The sensor of claim 2, wherein one of the first contact and the second contact is located on the printer carrier cable and the other of the first contact and second contact is located on the printer cartridge.

6. The sensor of claim 1, wherein the protective tape comprises an electrically-conductive material.

7. The sensor of claim 3, wherein the protective tape has a non-conductive body and includes a metal strip that bridges an electrical connection between the first contact and second contact upon the printer cartridge being in contact with the printer carrier cable.

8. The sensor of claim 1, wherein the protective tape has a non-conductive body and includes a conductive adhesive and the first contact and second contact are on the printer cartridge, and wherein the conductive adhesive bridges an electrical connection between the first contact and second contact, and the printer cartridge passes the voltage signal through the printer cartridge interface indicating that an electrical connection between the first contact and the second contact is bridged.

9. The sensor of claim 7, wherein the first contact and second contact are raised contacts that touch the metal strip of the protective tape upon the printer cartridge being in contact with the printer carrier cable.

10. A sensor circuit for detecting the presence of a protective tape on a printer cartridge for installation in a printer, the protective tape between a the printer cartridge and printer cartridge interface in a printer, the circuit comprising:

a voltage source for applying a test potential between a first contact and a second contact between the printer cartridge and printer cartridge interface;

a protective tape on the printer cartridge, the protective tape bridging an electrical connection between the first contact and second contact when the printer cartridge is in contact with the printer cartridge interface; and a voltage sensor in the printer, the sensor responsive to current between the first contact and second contact to thereby detect the presence of the protective tape strip.

11. The circuit of claim 10, further comprising an indicator responsive to the voltage sensor, the indicator providing a signal to the user of the printer when the presence of the protective tape strip in the installed position is detected.

12. The circuit of claim 10, wherein the printer cartridge interface is a printer carrier cable.

13. The circuit of claim 10, wherein the first contact and the second contact are located on the printer cartridge interface.

14. The circuit of claim 10, wherein the first contact and the second contact are located on the printer cartridge.

15. The circuit of claim 10, wherein one of the first contact and the second contact are located on the printer carrier cable, and the other of the first contact and second contact is located on the printer cartridge.

16. The circuit of claim 10, wherein the protective tape is comprised of an electrically-conductive material.

17. The circuit of claim 13, wherein the protective tape has a non-conductive body and includes a metal strip that bridges an electrical connection between the first contact and second contact upon the printer cartridge being in contact with the printer cartridge interface.

18. The circuit of claim 10, wherein the protective tape has a non-conductive body and includes a conductive adhesive and the first contact and second contact are on the printer cartridge, and wherein the conductive adhesive bridges an electrical connection between the first contact and second contact, and the printer cartridge passes the voltage signal through the printer cartridge interface to the voltage sensor indicating that an electrical connection between the first contact and the second contact is bridged.

19. The circuit of claim 17, wherein the first contact and second contact are raised contacts that touch the metal strip of the protective tape upon the printer cartridge being in contact with the printer cartridge interface.

20. A method of detecting the presence of a protective tape upon a printer cartridge installed into the printer cartridge interface of a printer, the method comprising the steps of:

placing a protective tape on the printer cartridge to protect the printer cartridge until usage in the printer;

placing the printer cartridge with the protective tape in contact with the printer cartridge interface of the printer, wherein the protective tape contacts at least a first contact and a second contact to bridge and electrical connection between the first contact and second contact; and passing a current from the first contact to the second contact to thereby close a sensing circuit to generate a signal indicating the protective tape is present on the printer cartridge.

21. The method of claim 20, further comprising the step of providing a signal to the user of the printer when the presence of the protective tape strip in the installed position is detected.

22. The method of claim 20, wherein the step of placing the printer cartridge with the protective tape in contact with the printer cartridge interface of the printer is placing the printer cartridge with the protective tape in contact with a printer carrier cable.

23. The method of claim 20, wherein the step of placing the printer cartridge with the protective tape in contact with the printer cartridge interface of the printer, wherein the protective tape contacts at least a first contact and a second contact to bridge an electrical connection between the first contact and second contact is placing the printer cartridge with the protective tape in contact with the printer cartridge interface of the printer, wherein the protective tape contacts a first contact and second contact located on the printer cartridge interface.

24. The method of claim 20, wherein the step of placing the printer cartridge with the protective tape in contact with the printer cartridge interface of the printer, wherein the protective tape contacts at least a first contact and a second contact to bridge and electrical connection between the first contact and second contact is placing the protective tape on a first contact and a second contact on the printer cartridge to bridge an electrical connection between the first contact and second contact and placing the printer cartridge in contact with the printer cartridge interface.

25. The method of claim 20, wherein the step of placing the printer cartridge with the protective tape in contact with the printer cartridge interface of the printer, wherein the protective tape contacts at least a first contact and a second contact to bridge and electrical connection between the first contact and second contact is placing the printer cartridge with the protective tape in contact with the printer cartridge interface of the printer, wherein the protective tape contacts one of the first contact and the second contact which is located on the printer carrier cable and the other of the first contact and second contact which is located on the printer cartridge to bridge an electrical connection between the first contact and second contact.

26. The method of claim 20, wherein the step of placing a protective tape on the printer cartridge to protect the printer cartridge until usage in the printer is placing a protective tape comprised of an electrically-conductive material on the printer cartridge to protect the printer cartridge until usage in the printer.

27. The method of claim 23, wherein the step of placing a protective tape on the printer cartridge to protect the printer cartridge until usage in the printer is placing a protective tape that has a non-conductive body and includes a metal strip that bridges an electrical connection between the first contact and second contact upon the printer cartridge to protect the printer cartridge until usage in the printer.

28. The method of claim 20, wherein the step of placing a protective tape on the printer cartridge to protect the printer cartridge until usage in the printer is placing protective tape having a non-conductive body and including a conductive adhesive that bridges an electrical connection between the first contact and second contact upon the printer cartridge to protect the printer cartridge until usage in the printer.

29. The method of claim 20, wherein the step of placing a protective tape on the printer cartridge to protect the printer cartridge until usage in the printer is placing a protective tape that has a non-conductive body and includes a metal strip that bridges an electrical connection between a first raised contact and second raised contact, the protective tape placed upon the printer cartridge to protect the printer cartridge until usage in the printer.

30. A sensor circuit for detecting the presence of a protective tape on a printer cartridge for installation in a printer, the protective tape between a the printer cartridge and printer cartridge interface in a printer, the circuit comprising:

a voltage source for applying a test potential between a first contact and a second contact between the printer cartridge and printer cartridge interface;

a non-conductive protective tape selectively upon the printer cartridge;

at least a third contact on the printer cartridge bridging an electrical connection between the first contact and second contact when the printer cartridge is in contact with the printer cartridge interface and the protective tape is not on the third contact; and a voltage sensor in the printer, the sensor responsive to current between the first contact and second contact to thereby detect the presence of the protective tape strip.

31. The circuit of claim 30, further comprising an indicator responsive to the voltage sensor, the indicator providing a signal to the user of the printer when the presence of the protective tape strip in the installed position is detected.

32. The circuit of claim 30, wherein the printer cartridge interface is a printer carrier cable.

33. The circuit of claim 30, further comprising a fourth contact on the printer cartridge electrically connected to the third contact, wherein the third contact connects to the first contact and the fourth contact connects to the second contact upon the printer cartridge being installed into the printer without the protective tape on the third contact and fourth contact of the printer cartridge to thereby close the sensing circuit.

34. A sensor for detecting the presence of a protective tape strip on a printer cartridge in contact with a printer cartridge interface in a printer, comprising:

a first contact and a second contact, wherein one of the first contact and the second contact is located on the printer carrier cable and the other of the first contact and second contact is located on the printer cartridge; and a non-conductive protective tape on the printer cartridge, wherein the protective tape impedes an electrical connection between the first contact and second contact when the printer cartridge is in contact with the printer cartridge interface.

35. The sensor of claim 34, wherein the printer cartridge interface is a printer carrier cable.

36. The sensor of claim 34, wherein the non-conductive protective tape impedes the electrical signals for an existing printer cartridge function.

37. The sensor of claim 36, wherein the non-conductive protective tape impedes the electrical signals of the contacts associated with temperature measurement of the printer cartridge.

* * * * *